US008047882B2

(12) United States Patent
Taylor

(10) Patent No.: US 8,047,882 B2
(45) Date of Patent: Nov. 1, 2011

(54) SELF-ALIGNING CONTACT ASSEMBLY

(75) Inventor: Attalee S. Taylor, Palmyra, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 336 days.

(21) Appl. No.: 12/389,952

(22) Filed: Feb. 20, 2009

(65) Prior Publication Data

US 2010/0216349 A1 Aug. 26, 2010

(51) Int. Cl.
*H01R 11/22* (2006.01)

(52) U.S. Cl. ..... 439/857

(58) Field of Classification Search ..... 439/82, 439/886, 188, 857, 839, 441, 833, 261, 288, 439/668; 29/874, 885
See application file for complete search history.

(56) References Cited

U.S. PATENT DOCUMENTS

| | | | | |
|---|---|---|---|---|
| 2,490,631 | A * | 12/1949 | Johansson | 439/857 |
| 4,863,388 | A * | 9/1989 | Reimer et al. | 439/31 |
| 5,208,978 | A | 5/1993 | Dixon et al. | |
| 6,488,550 | B1 * | 12/2002 | Kikuchi et al. | 439/857 |
| 6,572,419 | B2 * | 6/2003 | Feye-Homann | 439/839 |
| 2007/0105422 | A1 * | 5/2007 | Cvasa | 439/188 |

* cited by examiner

*Primary Examiner* — Edwin A. Leon

(57) ABSTRACT

A contact assembly includes a bifurcated contact and a mating contact. The bifurcated contact is elongated along a longitudinal axis with contact tips protruding from a common end of the bifurcated contact. The mating contact has an outer end and a body elongated along a major axis. The body includes a mating surface along a front face of the body. The outer end includes angled lead-in ramps that form transitions from the outer end to the mating surface. The lead-in ramps extend away from one another toward opposite sides of the mating contact. The bifurcated contact and the mating contact engage one another such that the contact tips of the bifurcated contact are directed along corresponding different lead-in ramps of the mating contact.

21 Claims, 3 Drawing Sheets

SELF-ALIGNING CONTACT ASSEMBLY

BACKGROUND OF THE INVENTION

Figure 2:
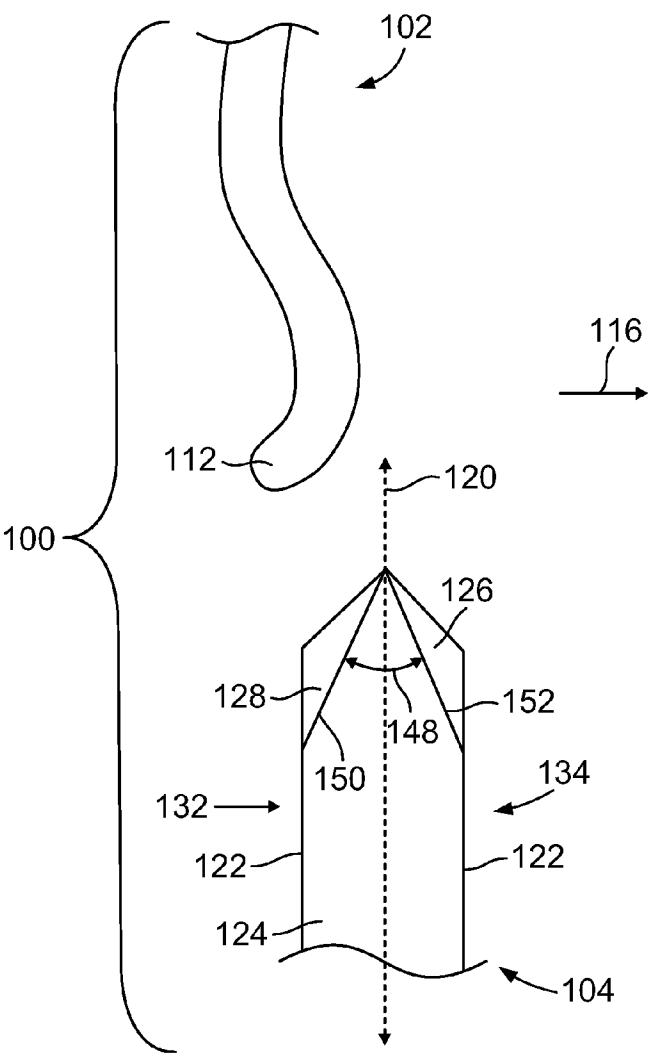

The subject matter herein relates generally to electrical connectors and, more particularly, to contacts in connectors that engage one another to electrically couple the connectors.

Electrical connectors include contacts shaped to mate with contacts of one or more other connectors to electrically couple the connectors. Some known connectors include housings that hold the contacts. The connector housings may include alignment features such as protruding polarization features. The alignment features of one connector engage corresponding alignment features of another connector to align the connectors with one another. The alignment of the connector housings helps to align the contacts in each connector with one another. When the contacts are aligned with one another, the contacts may electrically couple the connectors.

Relying on alignment between contacts and alignment features of a connector and alignment between the alignment features of the connector and a mating connector to mate the connectors adds to the complexity of manufacturing the connectors. The tolerances involved in placing the contacts in the housing relative to the alignment features may be relatively small. Moreover, due to manufacturing error, plastic deformation of connectors and/or contacts, and the like, contacts in the connectors may not properly align with one another when the connectors mate. For example, the contacts in a first connector may not be aligned with respect to the alignment features of the first connector. As a result, while the housing of first connector may properly align with a second connector, the contacts in the first connector may not be aligned with the contacts in the second connector. The misalignment of the contacts can degrade performance of the connectors. The integrity of signals communicated using the contacts may be damaged or the contact may fail to electrically couple the connectors, for example.

A need exists for connectors having contacts that align with contacts in mating connectors. Relying on the contacts in a connector to align with contacts in another connector may permit for relaxed manufacturing tolerances involved in placing the contacts in the connectors. Additionally, such self-aligning contacts may provide for more reliable and repeatable electrical connections between mated connectors.

BRIEF DESCRIPTION OF THE INVENTION

In one embodiment, a contact assembly is provided. The contact assembly includes a bifurcated contact and a mating contact. The bifurcated contact is elongated along a longitudinal axis with contact tips protruding from a common end of the bifurcated contact. The mating contact has an outer end and a body elongated along a major axis. The body includes a mating surface along a front face of the body. The outer end includes angled lead-in ramps that form transitions from the outer end to the mating surface. The lead-in ramps extend away from one another toward opposite sides of the mating contact. The bifurcated contact and the mating contact engage one-another such that the contact tips of the bifurcated contact are directed along corresponding different lead-in ramps of the mating contact. Optionally, the lead-in ramps guide the contact tips to center the bifurcated contact with respect to the mating surface in the direction transverse to the major axis. In another embodiment, the contact tips comprise arcuate cantilevered beams protruding from the common end of the bifurcated contact.

In another embodiment, a contact post is provided. The contact post is elongated along a longitudinal axis and is configured to mate with a bifurcated contact having contact tips protruding from a common end of the bifurcated contact. The contact post includes a mating surface and chamfered lead-in ramps. The mating surface is disposed parallel to the longitudinal axis. The lead-in ramps intersect the mating surface at a plurality of edges and are angled with respect to each of the mating surface and the longitudinal axis. The lead-in ramps guide the contact tips of the bifurcated contact to engage the bifurcated contact with the mating surface. Optionally, the contact post also includes lateral sides disposed on opposite sides of the mating surface. The lead-in ramps and the mating surface intersect one another at an outer end, with the lead-in ramps extending from the outer end to the lateral sides.

DETAILED DESCRIPTION OF THE INVENTION

Figure 1:
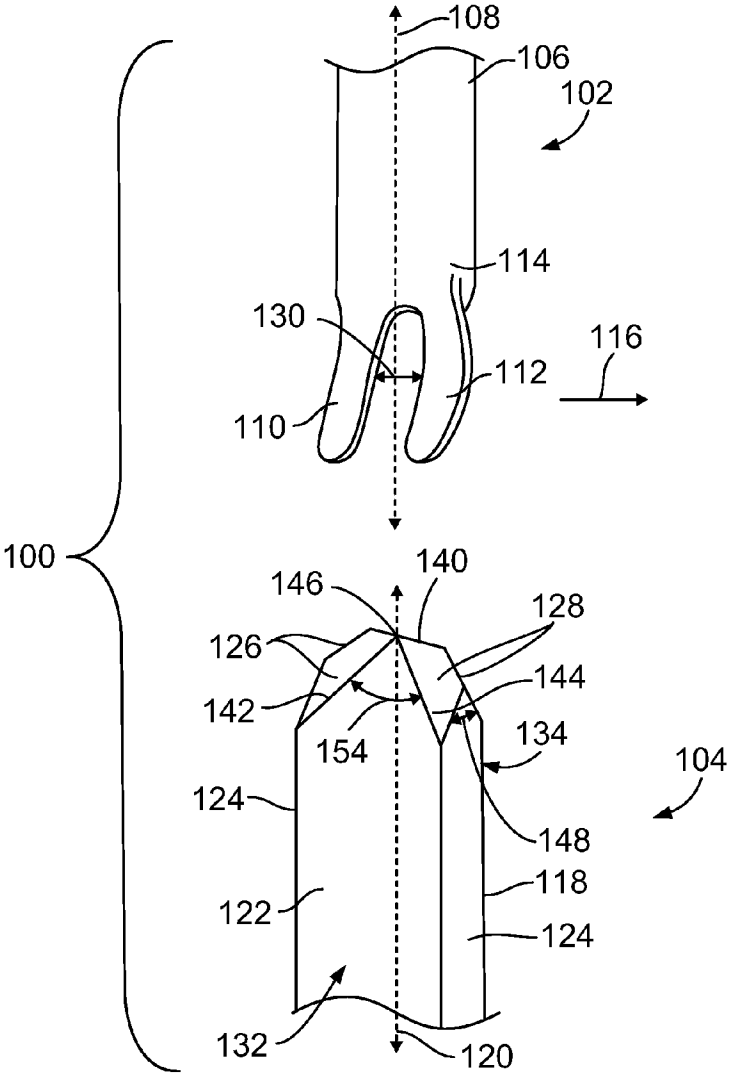

FIG. 1 illustrates a perspective view of a contact assembly 100 according to one embodiment of the presently described invention. FIG. 2 illustrates a side view of the contact assembly 100. The contact assembly 100 includes a bifurcated contact 102 and a mating contact 104 that engage one another to electrically join the bifurcated contact 102 and mating contact 104. The bifurcated contact 102 and mating contact 104 may include, or be formed from, a conductive material. For example, one or more of the bifurcated contact 102 and the mating contact 104 may be formed from a metal. Alternatively, one or more of the bifurcated contact 102 and the mating contact 104 may include, or be formed from, a dielectric material with a conductive plating or coating disposed thereon. Each of the bifurcated contact 102 and mating contact 104 may be components of separate electrical connectors (not shown). The bifurcated contact 102 and mating contact 104 engage one another to electrically couple the connectors (not shown).

The bifurcated contact 102 includes an elongated body 106 oriented along a longitudinal axis 108. A plurality of contact tips 110, 112 protrude from a common end 114 of the body 106. The contact tips 110, 112 protrude from the common end 114 of the bifurcated 102 in a direction that is parallel to the longitudinal axis 108 of the bifurcated contact 102. Each of the contact tips 110, 112 include cantilevered beams having an arcuate shape in the illustrated embodiment. For example, the contact tips 110, 112 may be arched or convex in an arcuate direction 116. The arcuate direction 116 may be transverse to the longitudinal axis 108. For example, the arcuate direction 116 may be approximately perpendicular to the longitudinal axis 108. The contact tips 110, 112 are separated by a gap 130 in a direction transverse to the longitudinal axis 108.

The mating contact 104 includes an elongated body 118 oriented along a major, or longitudinal, axis 120. For example, the mating contact 104 may be embodied in a contact post. In the illustrated embodiment, the mating contact 104 includes a mating surface 122 on each of opposite front and rear faces 132, 134 of the body 118. The body 118 also includes a plurality of lateral sides 124 disposed on opposite sides of the body 118 and located transverse to the length of the mating surfaces 122. The mating surfaces 122 may be approximately parallel to each other and the lateral sides 124 may be approximately parallel to one another such that the mating contact 104 has a polygon shaped cross-section.

The mating contact 104 includes a plurality of lead-in ramps 126, 128 extending downward from an outer end 140 of the mating contact 104. The lead-in ramps 126, 128 form transitions from the outer end 140 to the mating surface 122. The outer end 140 is the end of the body 118 of the mating contact 104 in one direction along the major axis 120. The outer end 140 may be an edge or a surface of the body 118. The lead-in ramps 126, 128 form transitions from the outer end 140 to the mating surface 122. In the illustrated embodiment, the lead-in ramps 126, 128 are chamfered surfaces. A pair of the lead-in ramps 126, 128 may be provided on each of the front and rear faces 132, 134 of the mating contact 104. Alternatively, the lead-in ramps 126, 128 may be provided on only one of the front and rear faces 132, 134.

The lead-in ramps 126, 128 are pitched downward and toward the lateral sides 124. For example, the lead-in ramps 126, 128 may be disposed at a forward angle 154 in the plane of the mating surfaces 122 and at a side angle 148 in the plane of the lateral sides 124 with respect to one another. For example, each of the lead-in ramps 126, 128 intersects the mating surface 122 at a corresponding edge 142, 144. The edges 142, 144 may be disposed at the forward angle 154 with respect to each other in the plane defined by the mating surface 122. In the illustrated embodiment, the forward angle 154 is approximately 45 degrees. The lead-in ramps 126, 128 intersect the lateral sides 124 at edges 150, 152. The edges 150, 152 may be disposed at the side angle 148 with respect to each other in the plane defined by the lateral side 124. In the illustrated embodiment, the side angle 148 is less than the forward angle 154. The side angle 148 may be approximately 30 degrees, for example. The lead-in ramps 126, 128 may be disposed, however, at a different forward and/or side angle 154, 148. The edges 142, 144 on each of the front and rear faces 132, 134 intersect each other at a vertex 146. The lead-in ramps 126, 128 and the mating surface 122 of each of the front and rear faces 132, 134 may intersect one another and the outer end 140 at the vertex 146. While the vertex 146 is illustrated as being located along the major axis 120, the vertex 146 may be located away from the major axis 120. For example, the vertex 146 may be shifted right or left of the major axis 120 relative to the view shown in FIG. 1.

In operation, the bifurcated contact 102 and the mating contact 104 engage one another by moving at least one of the bifurcated contact 102 and the mating contact 104 in a direction parallel to the major axis 120 of the mating contact 104. For example, the bifurcated contact 102 may be moved relative to the mating contact 104 downward in a direction parallel to the major axis 120 of the mating contact 104. Alternatively, the mating contact 104 may be moved relative to the bifurcated contact 102. As shown in FIG. 2, the bifurcated contact 102 is lowered onto the lead-in ramps 126, 128 on one of the front and rear faces 132, 134 of the mating contact 104. The bifurcated contact 102 is moved relative to the mating contact 104 until the contact tips 110, 112 engage the lead-in ramps 126, 128 of the mating contact 104. The vertex 146 of the mating contact 104 is disposed between the contact tips 110, 112 and within the gap 130 when the contact tips 110, 112 engage the lead-in ramps 126, 128. As described below, the contact tips 110, 112 engage the lead-in ramps 126, 128 and slide along the lead-in ramps 126, 128 until the contact tips 110, 112 engage the mating surface 122. The contact tips 110, 112 engage the mating surface 122 to provide an electrical connection between bifurcated contact 102 and the mating contact 104.

Figure 3:
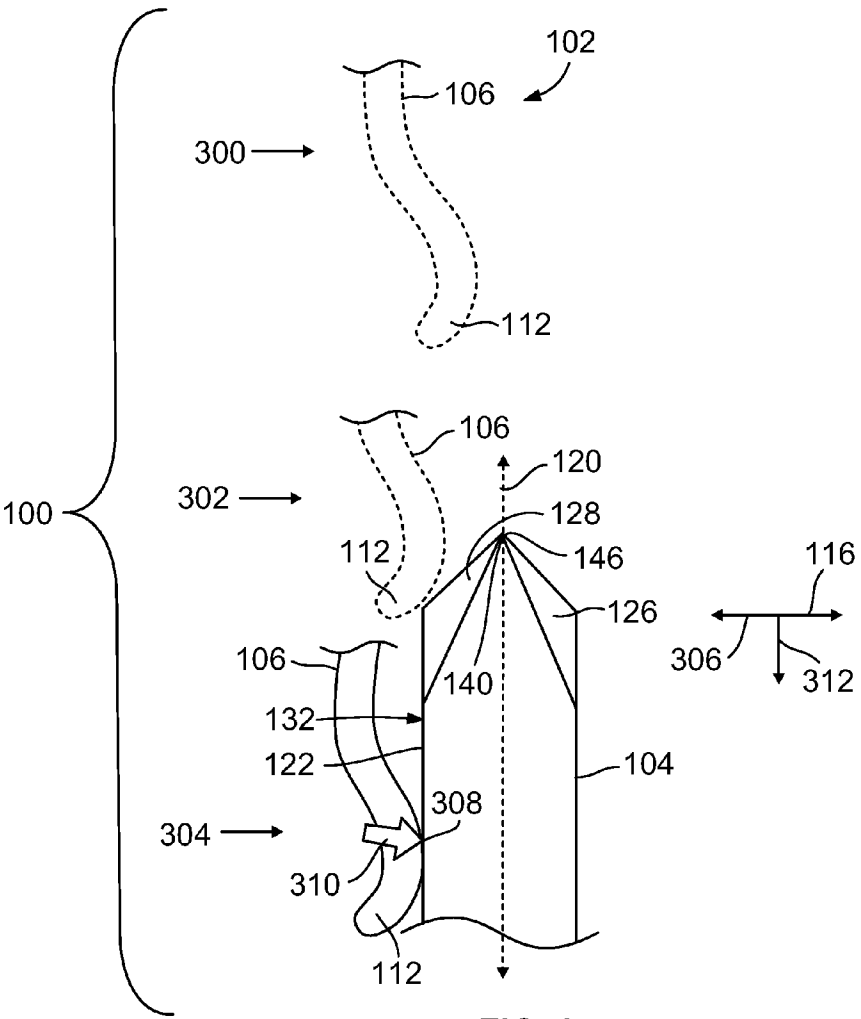

FIG. 3 is a side elevational view of the contact assembly 100 as the bifurcated contact 102 is moved between a pre-engagement position 300, a transition position 302, and a mated position 304. The bifurcated contact 102 is drawn in FIG. 3 using phantom lines in the pre-engagement position 300 and the transition position 302. The mating direction 312 is approximately parallel to the major axis 120 of the mating contact 104. In the pre-engagement position 300, the bifurcated contact 102 is located away from the mating contact 104. The pre-engagement position 300 includes the various positions of the bifurcated contact 102 prior to bringing the contact tips 110, 112 (shown in FIG. 1) into an engaged relationship with the lead-in ramps 126, 128. The contact tips 110, 112 are aligned with the lead-in ramps 126, 128 on the front face 132 of the mating contact 104 such that the contact tip 110 is aligned with the lead-in ramp 126 and the contact tip 112 is aligned with the lead-in ramp 128. Alternatively, the contact tips 110, 112 may be aligned with the lead-in ramps 126, 128 on the rear side 134 of the mating contact 104.

In the transition position 302, the contact tips 110, 112 (shown in FIG. 1) are brought into contact with the lead-in ramps 126, 128. The transition position 302 includes the various locations of the bifurcated contact 102 with respect to the mating contact 104 when the contact tips 110, 112 are in an engaged relationship with the lead-in ramps 126, 128. The body 106 of the bifurcated contact 102 may remain in approximately the same position in a direction parallel to the major axis 120 of the mating contact 104. For example, the body 106 may be moved along the mating direction 312 while remaining approximately equidistant from the major axis 120. As the contact tips 110, 112 engage the lead-in ramps 126, 128, the contact tips 110, 112 may slightly deflect in a lateral direction 306. The lateral direction 306 is in a direction opposite of the arcuate direction 116 in one embodiment. The distance in which the contact tips 110, 112 are deflected in the lateral direction 306 may increase throughout the transition position 302 as the contact tips 110, 112 slide along the lead-in ramps 126, 128. For example, lead-in ramps 126, 128 are angled with respect to the major axis 120 such that the lead-in ramps 126, 128 extend from proximate the vertex 146 out to the mating surface 122. The distance that the contact tips 110, 112 are deflected in the lateral direction 306 may continue to increase until the contact tips 110, 112 engage the mating surface 122 in the mated position 304.

The lead-in ramps 126, 128 guide the contact tips 110, 112 toward the mating surface 122. At the mated position 304, the contact tips 110, 112 (shown in FIG. 1) are in contact with the mating surface 122. For example, convex surfaces 308 of the contact tips 110, 112 may slide along the lead-in ramps 126, 128 throughout the transition position 302 until the convex surfaces 308 engage the mating surface 122. The mated position 304 includes the locations of the bifurcated contact 102 in which the contact tips 110, 112 engage the mating surface 122 to electrically couple the bifurcated contact 102 with the mating contact 104. As shown in FIG. 3, the contact tips 110, 112 (shown in FIG. 1) are slightly deflected in the lateral direction 306 when in the mated position 304. For example, the body 106 of the bifurcated contact 102 may be held in a housing (not shown) of a connector (not shown) such that the body 106 is unable to move in the lateral direction 306 as the bifurcated contact 102 is moved in the mating direction 312. The deflection of the contact tips 110, 112 may help to ensure engagement between the bifurcated contact 102 and the mating contact 104. For example, the deflection of the contact tips 110, 112 may cause the bifurcated contact 102 to exert a responsive force 310 on the mating surface 122 in the arcuate direction 116. The responsive force 310 may maintain contact between the contact tips 110, 112 and the mating surface 122 in order to maintain an electrically conductive pathway between the bifurcated contact 102 and the mating contact 104.

Figure 4:
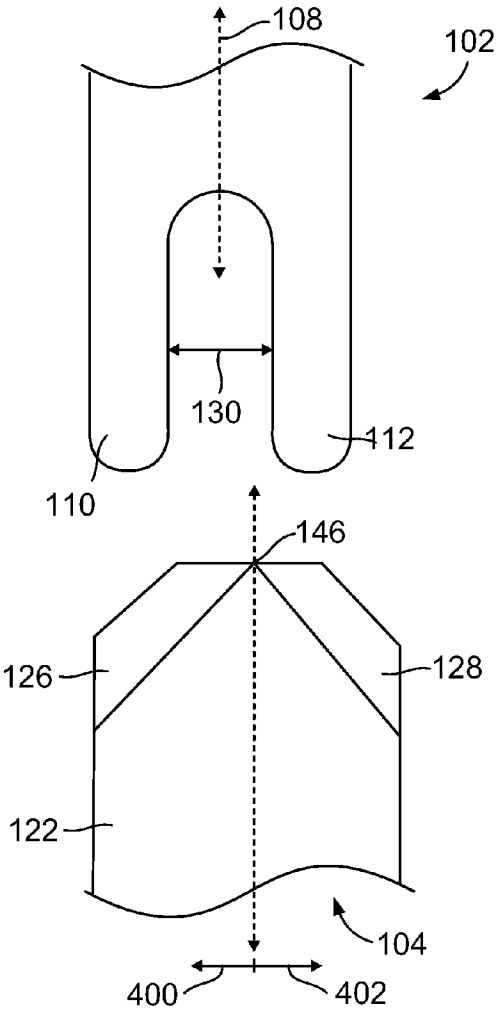
Figure 6:
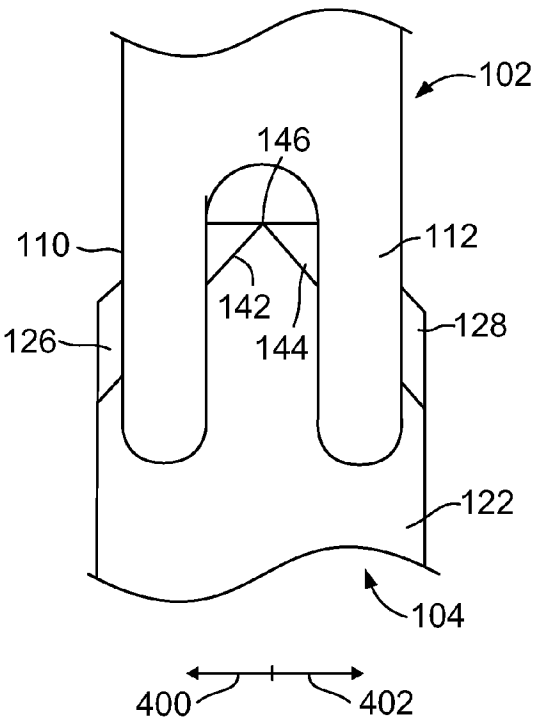
Figure 5:
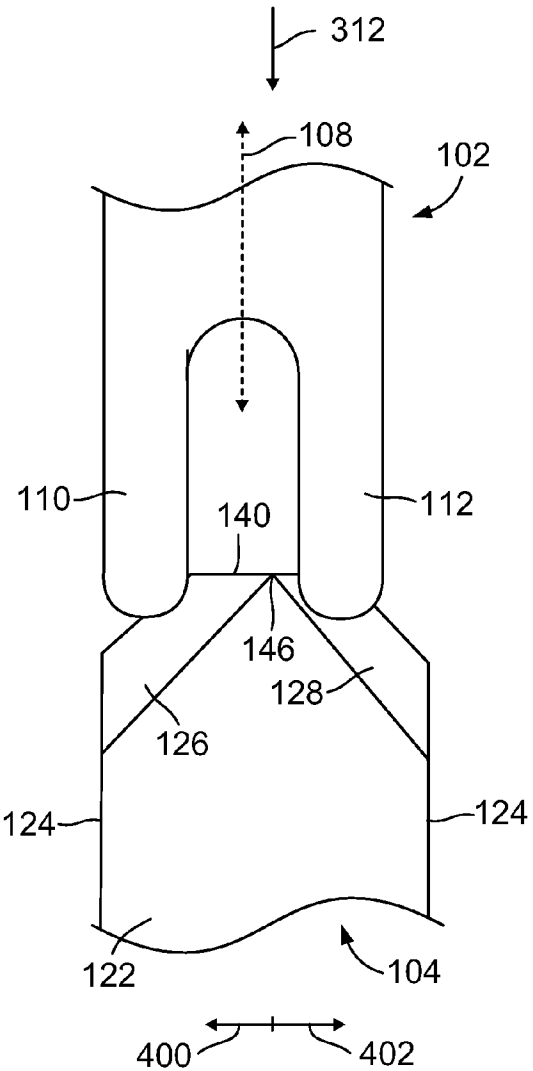

FIGS. 4-6 illustrate front elevational views of the contact assembly 100 as the bifurcated contact 102 and mating contact 104 engage one another according to one embodiment. FIG. 4 illustrates the contact assembly 100 prior to the bifurcated contact 102 engaging the mating contact 104. FIG. 4 may correspond to the side elevational view of the contact assembly 100 represented as the pre-engagement position 300 shown in FIG. 3. The contact assembly 100 may self-align the bifurcated contact 102 with the mating contact 104 in accordance with one embodiment. The bifurcated contact 102 may be mis-aligned with the mating contact 104 prior to mating the bifurcated contact 102 with the mating contact 104. The mating contact 104 may align the bifurcated contact 102 along the mating surface 122 of the mating contact 104 to ensure an electrically conductive coupling between the bifurcated contact 102 and the mating contact 104. For example, the mating contact 104 may align the bifurcated contact 102 with respect to the major axis 120 in order to ensure that both of the contact tips 110, 112 engage the mating surface 122 to electrically couple the mating contact 104 and the bifurcated contact 102.

For example, the bifurcated contact 102 may be mis-aligned with respect to the mating contact 104 where the vertex 146 of the mating contact 104 is not aligned with the longitudinal axis 108 of the bifurcated contact 102 along first and second transverse directions 400, 402. The transverse directions 400, 402 extend in opposite directions that are transverse to the major axis 120. The transverse directions 400, 402 may be approximately perpendicular to the major axis 120 in the plane of the mating surface 122. In another example, the vertex 146 may not be centered along the gap 130 between the contact tips 110, 112, as shown in FIG. 4. As described below, the engagement between the lead-in ramps 126, 128 and the contact tips 110, 112 may align the bifurcated contact 102 with respect to the major axis 120 along the mating surface 122. Alternatively, the engagement between the lead-in ramps 126, 128 and the contact tips 110, 112 may align the bifurcated contact 102 with respect to the vertex 146 where the vertex 146 is not aligned with or disposed on the major axis 120.

FIG. 5 illustrates the contact tips 110, 112 of the bifurcated contact 102 engaging the lead-in ramps 126, 128 of the mating contact 104. FIG. 5 may correspond to the side elevational view of the contact assembly 100 represented as the transition position 302 shown in FIG. 3. The contact tips 110, 112 engage the lead-in ramps 126, 128 and slide along the lead-in ramps 126, 128 as the bifurcated contact 102 is moved along the mating direction 312 toward the mating contact 104, or as the mating contact 104 is moved toward the bifurcated contact 102. Due to the downward pitch of the lead-in ramps 126, 128 from the outer end 140, the lead-in ramps 126, 128 guide the contact tips 110, 112 downward toward the mating surface 122.

The pitch of the lead-in ramps 126, 128 toward the lateral sides 124 of the mating contact 104 align the bifurcated contact 102 with respect to the vertex 146. For example, the pitch of the lead-in ramps 126, 128 toward the opposite lateral sides 124 guides the contact tips 110, 112 in a direction to align the contact tips 110, 112 with respect to the vertex 146. In the illustrated embodiment, the lead-in ramps 126, 128 guide the bifurcated contact 102 in the second transverse direction 402. Because the vertex 146 is aligned on the right side of the longitudinal axis 108 of the bifurcated contact 102, the lead-in ramps 126, 128 guide the bifurcated contact 102 in the second lateral direction 402 in the illustrated embodiment. Alternatively, the lead-in ramps 126, 128 may guide the bifurcated contact 102 in the first transverse direction 400 if the vertex 146 initially is aligned on the left side of the longitudinal axis 108. The lead-in ramps 126, 128 may continue to guide the contact tips 110, 112 downward in the mating direction 312 and along the first or second transverse direction 400, 402 until the contact tips 110, 112 engage the mating surface 122.

The contact tips 110, 112 may flex along the first and second transverse directions 400, 402 as the contact tips 110, 112 slide down the lead-in ramps 126, 128. For example, in the illustrated embodiment, the contact tip 110 may flex in the first transverse direction 400 and the contact tip 112 may flex in the second lateral direction 402 when the contact tip 112 engages the lead-in ramp 128 and is moved downward along the mating direction 312.

FIG. 6 illustrates the bifurcated contact 102 in a mated relationship with the mating contact 104. FIG. 6 may correspond to the side elevational view of the contact assembly 100 represented as the mated position 304 shown in FIG. 3. As described above, the lead-in ramps 126, 128 guide the contact tips 110, 112 into engagement with the mating surface 122. The contact tips 110, 112 slide along the lead-in ramps 126, 128 past the edges 142, 144 and onto the mating surface 122. The bifurcated contact 102 and mating contact 104 are electrically coupled and capable of communicating signals between one another once the contact tips 110, 112 engage the mating surface 122. As shown in FIG. 6, the lead-in ramps 126, 128 guide the contact tips 110, 112 toward the mating surface 122 and align the contact tips 110, 112 with respect to the vertex 146. For example, the contact tips 110, 112 are disposed at approximately equal distances from the vertex 146 and are centered on the mating surface 122 along the first and second transverse directions 400, 402.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A contact assembly comprising:

a bifurcated contact elongated along a longitudinal axis with contact tips protruding from a common end of the bifurcated contact; and a mating contact having an outer end and a body elongated along a major axis, the body comprising a mating surface along a front face of the body, the outer end including angled lead-in ramps that form transitions from the outer end to the mating surface, the lead-in ramps extending away from one another toward opposite sides of the mating contact, wherein the bifurcated contact and the mating contact engage one another such that the contact tips of the bifurcated contact are directed along corresponding different lead-in ramps of the mating contact to engage the same mating surface on the front face of the mating contact.

2. The contact assembly of claim 1, wherein the lead-in ramps guide the contact tips to center the bifurcated contact with respect to the mating surface in a direction transverse to the major axis.

3. The contact assembly of claim 1, wherein the contact tips protrude from the common end of the bifurcated contact in a direction parallel to the longitudinal axis.

4. The contact assembly of claim 1, wherein the contact tips comprise arcuate cantilevered beams protruding from the common end of the bifurcated contact.

5. The contact assembly of claim 1, wherein the contact tips flex away from one another in opposing directions transverse to the major axis of the mating contact when the contact tips slide along the lead-in ramps.

6. The contact assembly of claim 1, wherein the lead-in ramps are angled with respect to the mating surface.

7. The contact assembly of claim 1, wherein the lead-in ramps are angled with respect to one another.

8. The contact assembly of claim 1, wherein the lead-in ramps and the mating surface of the mating contact intersect one another at a vertex of the mating contact, the contact tips of the bifurcated contact engaging the lead-in ramps on opposite sides of the vertex to align the bifurcated contact with respect to the mating contact.

9. The contact assembly of claim 1, wherein the lead-in ramps of the mating contact guide the contact tips of the bifurcated contact to the mating surface of the mating contact, the contact tips engaging the mating surface to electrically couple the bifurcated contact with the mating contact.

10. The contact assembly of claim 1, wherein each of the lead-in ramps intersect the mating surface at an edge, the edges between the mating surface and each of the lead-in ramps extending along the mating surface at an acute angle with respect to one another.

11. The contact assembly of claim 10, wherein the acute angle is approximately 45 degrees or less.

12. The contact assembly of claim 1, wherein the body of the mating contact comprises a rear face opposite of the front face, the rear face including a mating surface and angled lead-in ramps that form transitions from the outer end to the mating surface of the rear face, further wherein the lead-in ramps of the rear face are configured to guide the contact tips to the mating surface of the rear face.

13. A contact post elongated along a longitudinal axis and configured to mate with a bifurcated contact having contact tips protruding from a common end of the bifurcated contact, the contact post comprising:

a mating surface disposed parallel to the longitudinal axis; and chamfered lead-in ramps intersecting the mating surface at a plurality of edges, the lead-in ramps angled with respect to each of the mating surface and the longitudinal axis, wherein the lead-in ramps guide the contact tips of the bifurcated contact to engage the contact tips with the same mating surface.

14. The contact post of claim 13, wherein the lead-in ramps are configured to center the contact tips on the mating surface with respect to the longitudinal axis.

15. The contact post of claim 13, further comprising lateral sides disposed on opposite sides of the mating surface, wherein the lead-in ramps and the mating surface intersect one another at an outer end, the lead-in ramps extending from the outer end to the lateral sides.

16. The contact post of claim 13, further comprising lateral sides disposed on opposite sides of the mating surface, wherein the lead-in ramps are angled with respect to each of the lateral sides and the mating surface.

17. The contact post of claim 13, wherein the edges are disposed at an angle of approximately 45 degrees or less with respect to one another.

18. The contact post of claim 13, wherein the lead-in ramps are disposed at an angle with respect to one another.

19. The contact post of claim 13, further comprising opposite front and rear faces of the contact post, the front face including the mating surface and the lead-in ramps, wherein the rear face includes an additional mating face and additional lead-in ramps, the additional lead-in ramps configured to guide the contact tips to engage the additional mating face.

20. The contact assembly of claim 1, wherein the mating surface of the front face of the mating contact is a planar surface and both of the contact tips of the bifurcated contact concurrently engage the same planar surface of the mating contact.

21. The contact post of claim 13, wherein the mating surface is a planar surface and both of the contact tips of the bifurcated contact concurrently engage the same planar surface of the mating surface.

* * * * *